US005304984A

United States Patent [19]

Roldan

[11] Patent Number: 5,304,984

[45] Date of Patent: Apr. 19, 1994

[54] BELT TENSION SIGNALLING DEVICE

[76] Inventor: Eduardo L. Roldan, 4188 Greystone Dr., Yorba Linda, Calif. 92686

[21] Appl. No.: 503,265

[22] Filed: Apr. 2, 1990

[51] Int. Cl.[5] ..... G08B 23/00; G08B 25/08

[52] U.S. Cl. ..... 340/573; 340/407.1; 340/668; 340/692

[58] Field of Search ..... 340/573, 668, 311.1, 340/407, 692, 384 E; 128/782

[56] References Cited

U.S. PATENT DOCUMENTS

| | | | |
|---|---|---|---|
| 2,632,155 | 3/1953 | Lamb | 340/692 X |
| 3,656,158 | 4/1972 | Goodwater | 340/693 X |
| 4,055,168 | 10/1977 | Miller et al. | 340/573 X |
| 4,107,464 | 8/1978 | Lynch et al. | 340/692 X |
| 4,157,540 | 6/1979 | Oros | 340/573 X |
| 4,162,490 | 7/1979 | Fu et al. | 340/573 X |
| 4,191,949 | 3/1980 | Myers | 340/573 |
| 4,300,129 | 11/1981 | Cataldo | 340/573 X |
| 4,392,126 | 7/1983 | Loyola | 340/573 |
| 4,798,538 | 1/1989 | Yagi | 128/721 X |
| 4,801,921 | 1/1989 | Zigenfus | 340/573 |
| 4,846,462 | 7/1989 | Regnier et al. | 340/573 X |
| 4,871,998 | 10/1989 | Chaillou | 340/573 |
| 4,914,423 | 4/1990 | Fernandez | 340/573 |

*Primary Examiner*—John K. Peng
*Assistant Examiner*—Thomas J. Mullen, Jr.
*Attorney, Agent, or Firm*—J. Mark Holland; Thomas P. Mahoney

[57] ABSTRACT

A posture improvement device is provided, in which a predetermined amount of tension in a belt around the wearer's waist closes a switch and activates a buzzer, vibration motor, or other indicating means in a belt buckle of said belt. Means are provided to adjust the amount of tension required to achieve said closing of said switch. By maintaining sufficient tautness in his or her abdominal and lower back muscles, the wearer can maintain the tension in the belt below the predetermined threshold level, and correspondingly maintain desired improved posture. Conversely, slouching or relaxation of said muscles closes said switch and signals the wearer to improve his or her posture.

19 Claims, 4 Drawing Sheets

BELT TENSION SIGNALLING DEVICE

BACKGROUND OF THE INVENTION

This invention relates to posture improvement devices, and particularly to signalling devices of the character that are utilized to indicate poor posture. The signalling device of my invention is useful for several purposes, including assisting a person to improve his posture, strengthen his abdominal and back muscles, achieve a more desirable waistline, and improve his breathing mechanics, among others.

Good posture benefits a person's appearance as well as his general health. In addition, good posture may be effective to prevent or correct certain back ailments. In particular, contracting one's abdominal and lower back muscles generally results in good posture and improves one's appearance by reducing one's waistline.

Thus, desirable posture is integrally related to the strength and utilization of a person's abdominal and back muscles. Improvement of one's posture can therefore be directly related to the development and exercise of those muscles.

In addition to or as an alternative to active, focused exercises to accomplish the desired and beneficial muscle development, it has been found that signalling devices can be worn on certain areas of the human body to alert the wearer when the relevant muscles are excessively relaxed or when the wearer's posture otherwise needs to be improved. Utilized properly, such devices enable a person to "train" his abdominal and back muscles to maintain good posture.

Prior art signalling devices are directed to the aforesaid desirable result but have significant shortcomings. Illustrative of the cumbersome, inconvenient nature of such prior art devices are the devices of U.S. Pat. No. 3,608,541 to Hall, U.S. Pat. No. 4,750,480 to Janness, U.S. Pat. No. 3,908,279 to Yoslow et al., U.S. Pat. No. 4,007,733 to Celest et al., U.S. Pat. No. 4,055,168 to Miller et al., and U.S. Pat. No. 4,730,625 to Fraser et al. These devices involve substantial modifications or additions to normal articles of clothing, and appear to cause some discomfort or at least to be significantly noticeable to the wearer. For example, the mechanism of Hall requires numerous restrictive straps enwrapping the wearer's torso. By way of further example, the device of Miller utilizes a harness cable extending around the longitudinal axis of the body from the pubis to the scapula.

It further appears that the foregoing prior art devices may be detected by persons observing the wearer, which is an undesirable aspect in some, if not most, circumstances.

OBJECTS AND ADVANTAGES OF THE INVENTION

It is, therefore, an object of my invention to provide a posture correction device that achieves the aforesaid desirable signalling whereby the wearer may monitor and correct his posture, but which does so in a convenient, comfortable, and unobtrusive manner that is relatively unnoticeable to persons other than the wearer.

Another object of the invention is the provision of a posture correction device of the aforementioned character in which the desired signalling is achieved by the incorporation of tension sensing means and indicating means into a belt buckle of normal dimensions. The belt buckle may be incorporated into a standard belt to be worn around the waist. When the wearer's abdominal muscles are undesirably relaxed or the wearer slouches, the circumference of the wearer's waist will increase, causing a corresponding increase in tension in the belt. This in turn activates the indicating means which alerts the wearer to correct his or her poor posture.

A further object of my invention is the provision of a sensing device of the aforementioned character which includes adjustment means to allow the wearer to precisely control the amount of tension (and correspondingly the amount of relaxation of the wearer's abdominal and back muscles) required to activate the indicating means.

Still another object of my invention is the provision of a signalling mechanism of the aforesaid character which includes in its indicating means one or more of: a vibration-producing motor in the belt buckle; a buzzer or other sound-producing mechanism in the buckle; or adapter means to be utilized in conjunction with a Walkman® or other stereo or radio to interrupt the sound produced by such stereo or radio.

An additional object of my invention is the provision of a signalling device of the aforementioned character which may be readily utilized in conjunction with any of a broad range of belts that may be owned by the wearer.

A further object of my invention is the provision of a belt buckle of the aforementioned character in which the indicator means is activated through the incorporation of switch means, in which said switch means includes a slideable, spring-biased actuating arm operably associated with the belt buckle.

Other objects and advantages of the invention will be apparent from the following specification and the accompanying drawings, which are for the purpose of illustration only.

DESCRIPTION OF PREFERRED EMBODIMENT

Figure 1:
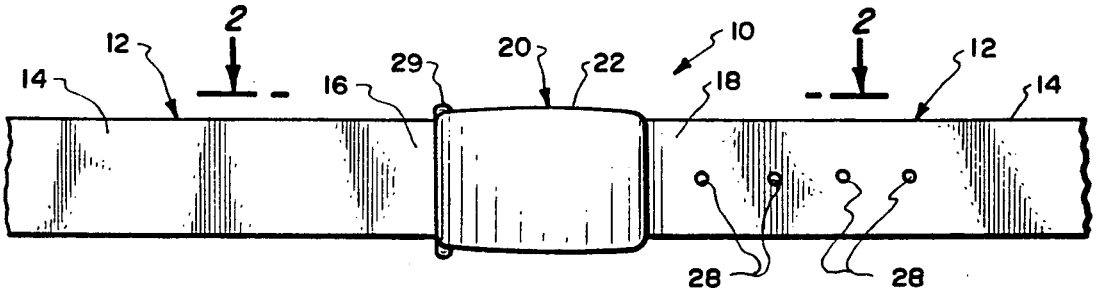
FIG. 1 is a fragmentary elevational view of a preferred embodiment of a posture monitoring device constructed in accordance with the teachings of the invention.

Referring to the drawings, and particularly to FIGS. 1–7 thereof, I show a preferred embodiment of a posture improvement device 10 constructed in accordance with the teachings of the invention and including belt means 12 shown as a belt member 14 having a first end 16 and a second end 18. The invention further includes belt buckle means or housing means 20 shown as belt buckle member 22 attached to the first end 16 of the belt member 14 through the use of known toothed clamp means 24 or a suitable equivalent.

Toothed clamp means 24 or its equivalent permits the device of my invention to be utilized in combination with any of a broad range of belts which may already be owned by the wearer. In the preferred embodiment, for example, clamp means 24 may be pivoted on pin members 25, FIG. 6, to release the first end 16 of the belt member 14 and permit its removal. Subsequently, an end of another suitable belt member may be juxtaposed to the clamp means 24 which may then be pivoted back into clamping engagement thereon.

The posture improvement device of my invention further includes an actuating arm 26 operably engageable with any of a series of holes 28 in the second end of the belt means 12, whereby the belt member 14 may be worn around a person's waist or abdomen. A strap retaining member 29 is provided to retain the outermost portion of the second end 18 in operative alignment with the other components of the device.

Those skilled in the art will understand that my invention may be practiced with alternative embodiments of the assembly of the second end 18, the actuating arm 26, and the strap retaining member 29. In addition to the examples illustrated in the drawings and discussed hereinbelow, the actuating arm and the strap retaining member may extend away from the wearer rather than toward the wearer, permitting the second end 18 of the belt to overlap the front of the buckle means 20. In such an embodiment, the retaining member 29 might be constituted by a perimetrical retaining ring or a false front on the buckle member 22, whereby the end 18 is maintained in the aforesaid operative alignment with the housing means 20. This embodiment would permit the device to be utilized in a more conventional manner than having the second end 18 underlying the buckle means 20.

From the drawings and from the foregoing description, it will be obvious that the device of my invention has an outward appearance that is very conventional and that prevents persons other than the wearer from detecting that the device is anything other than a normal belt; that is, it may be worn about a person's waist as any normal or standard belt may be worn. It will be understood that the above-described components of the preferred embodiment of my invention may be manufactured from any of a range of materials typically utilized in such belts. For example, but not by way of limitation, the belt member 14 may be constructed from leather, cloth, metal, or other material having sufficient tensile strength to withstand the tension and wear to which such belts are exposed.

The buckle or housing means 20 shown as buckle member 22 must be of sufficient size and strength to house and operatively accommodate the functions of the various switching, activation, indicator or signalling means hereafter described. Moreover, the buckle member 22 is preferably manufactured from a strong, lightweight metal or hard plastic to provide a suitable amount of protection for such switching, activation, indicator or signalling means, as well as to be able to withstand the vibrations and other wear and tear associated with such switching, indicating or signalling.

Figure 2:
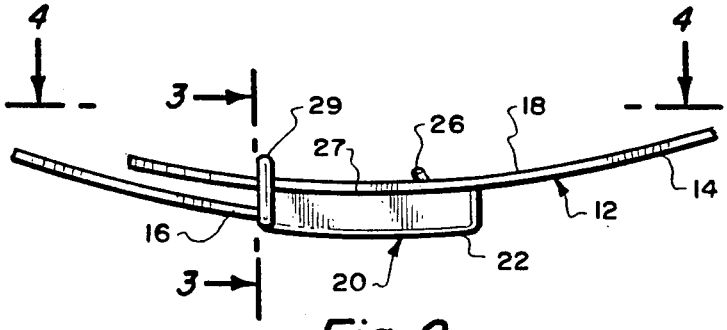
FIG. 2 is a top plan view, taken along line 2—2 of FIG. 1.
Figure 3:
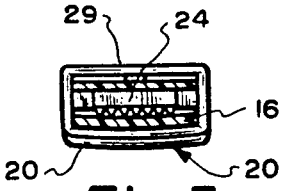
FIG. 3 is a partially sectional end view, taken along line 3—3 of FIG. 2.

In the preferred embodiment, the buckle member 22 is configured to include a contacting surface 27, FIG. 2, that is slightly concave so that it approximates the curvilinear plane of the surface of the wearer's abdomen. Although the invention may be practiced with a flat planar surface 27, the aforedescribed concavity improves the engagement between the actuating arm 26 and the selected one of the holes 28 in the belt member 14.

Figure 4:
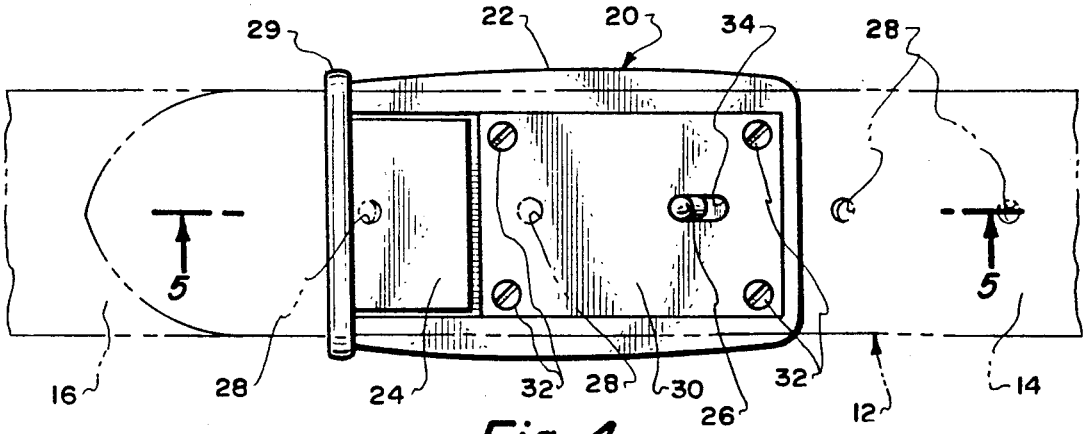
FIG. 4 is a rear elevational view with the belt member shown in shadow, taken along line 4—4 of FIG. 2.
Figure 5:
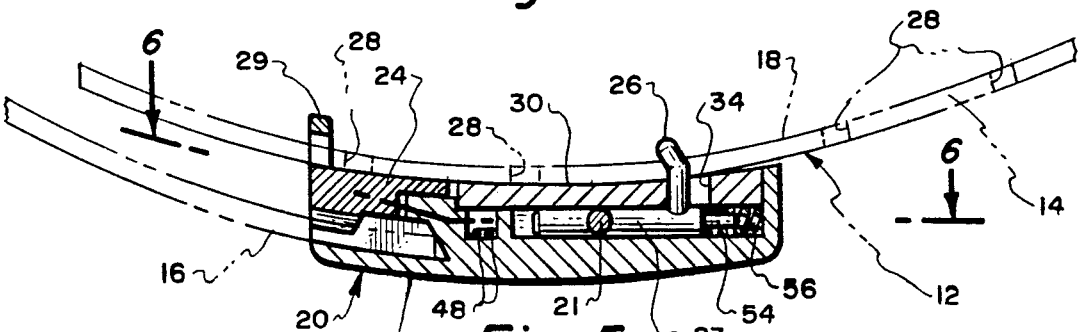
FIG. 5 is a sectional view, taken along line 5—5 of FIG. 4.
Figure 6:
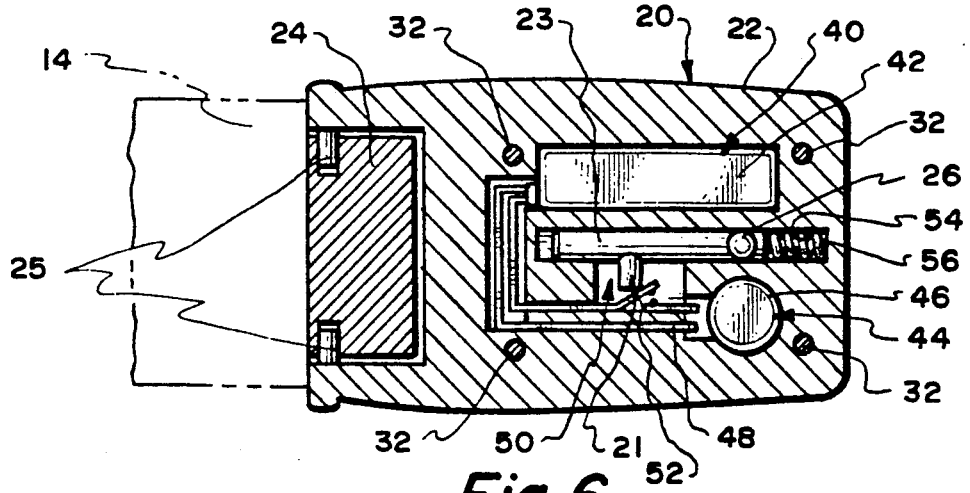
FIG. 6 is a sectional view, taken along line 6—6 of FIG. 5 and showing the device with its switch means open.
Figure 7:
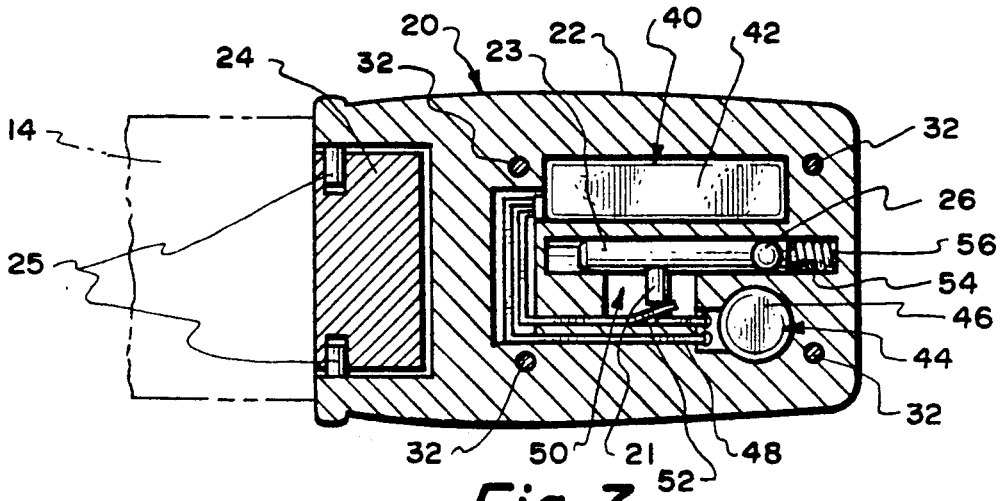
FIG. 7 is a sectional view similar to FIG. 6, but illustrating the device in a signal-producing configuration.

The device of my invention further includes, in the preferred embodiment, a plate 30, FIG. 4, removably attached to and constituting the back of housing means 20. The plate 30 is attached by screws 32 or their equivalent and contains a slot 34 to permit reciprocating sliding motion of the actuating arm 26 as more thoroughly described below.

The buckle or housing means 20 of my invention further includes, in the preferred embodiment, indicator or signalling means 40 such as a vibration-producing member shown as vibration motor 42, a power source 44 such as a battery 46, and circuitry 48 whereby the battery 46 may activate the vibrating motor 42. These components are contained in internal cavities in the buckle member 22 and are accessible by removal of the back plate 30.

The circuitry 48 includes activation or switch means 50 to control the operation of the vibration motor 42. Switch means 50 includes a switch member 52, the actuating arm 26, and biasing means 54 such as a spring 56 operably engaged with the actuating arm 26. In the preferred embodiment of my invention, the actuating arm 26 includes a cylindrical body portion 23 slidably disposed and operably retained in an internal cavity in the buckle member 22. A protuberance 21 on the body portion 23 operably contacts the switch member 52 as the actuating arm 26 is reciprocated with respect to the buckle member 22, as now described.

To utilize the preferred embodiment of my invention, the wearer places the belt means 12 around his waist or abdomen and engages the actuating arm 26 in one of the holes 28 so that the belt fits snugly when the wearer is maintaining proper posture. In this position, the spring 56 biases the actuating arm 26 to a location in the cavity in the buckle member 22 such that the protuberance 21 permits the switch member 52 to be in a normally open position. In such a configuration, the electrical circuit between the battery 46 and the signalling means 40 is open, and therefore the vibration motor 42 does not operate.

When the wearer slouches or otherwise relaxes his abdominal or back muscles, however, the circumference of the wearer's waist increases. Correspondingly, the expansive hoop stress or tension in the belt member 14 increases. If the muscles are relaxed to a sufficient extent, the tension in the belt member 14 overcomes the bias of the spring 56 and causes the actuating arm 26 to move to the right when viewing FIG. 6. With sufficient muscle relaxation or slouching, the actuating arm 26 will be urged to the position shown in FIG. 7, whereby the protuberance 21 contacts and closes the switch member 52 and completes the circuit between the power source 46 and the indicating means 40. Upon this completion of the circuit, the vibration motor 42 is activated and the wearer senses a slight vibration of the buckle member 22, which signals the wearer to tighten his abdominal or back muscles or otherwise correct his posture.

Figure 8:
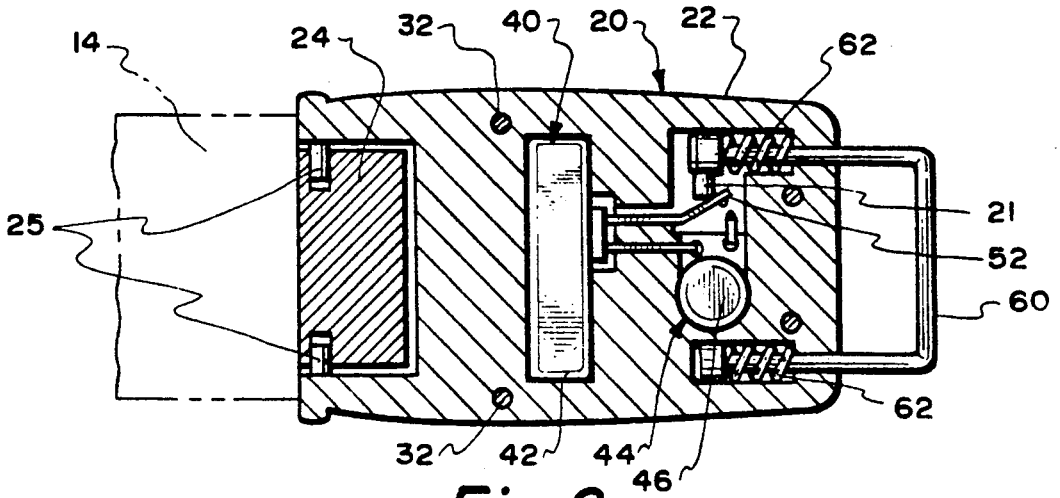
FIG. 8 is a sectional view similar to FIG. 6, but illustrating an alternative embodiment of the switching means of the invention with its switch means open.
Figure 9:
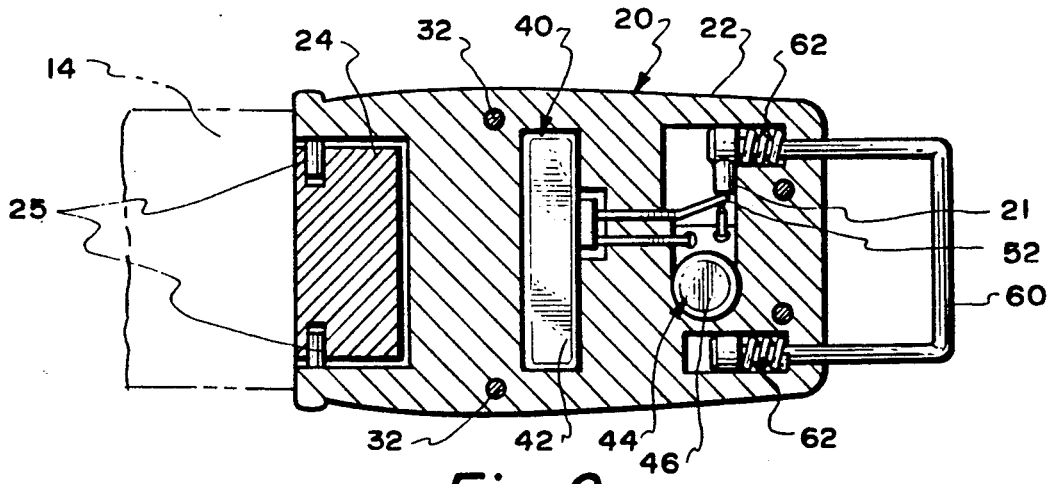
FIG. 9 is a sectional view of the alternative embodiment of FIG. 8, but illustrating the device in a signal-producing configuration.

The actuating arm 26 may alternatively be constituted by a U-shaped actuating arm member 60, FIGS. 8-9, operably slidably disposed in bores and cavities in the buckle housing means 20. The U-shaped member 60 may be utilized with many styles of belt members 14, such as belts having a second end 18 which may be secured around the member 60 rather than having the holes 28 engageable with an actuating arm 26. Similarly to the embodiment of FIGS. 1-7, the biasing force of the spring means 62 of this alternative embodiment is overcome when the wearer's posture needs to be improved, completing the circuit and signalling the wearer to so improve his posture.

Figure 11:
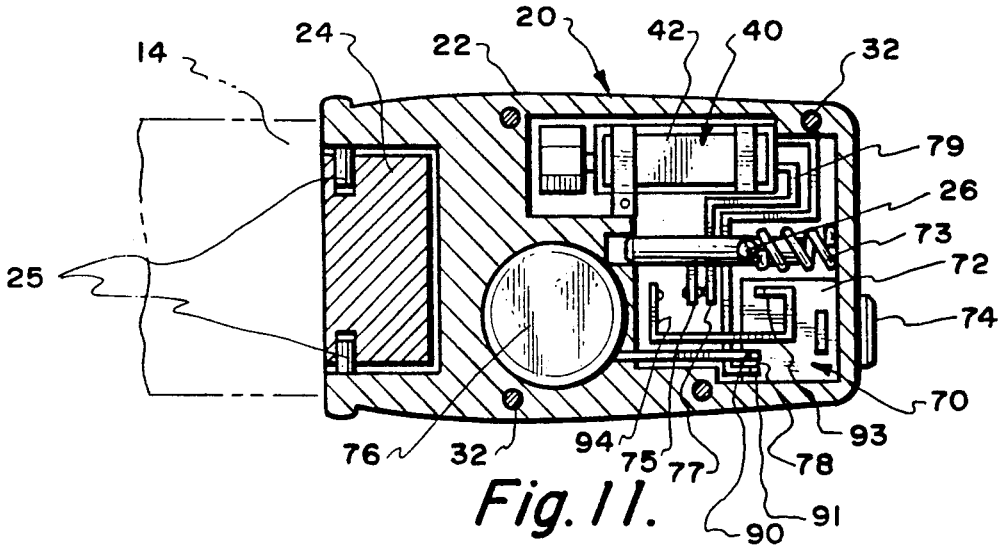
FIG. 11 is a sectional view of the alternative embodiment of FIG. 10, but illustrating the device in a signal-producing configuration.
Figure 10:
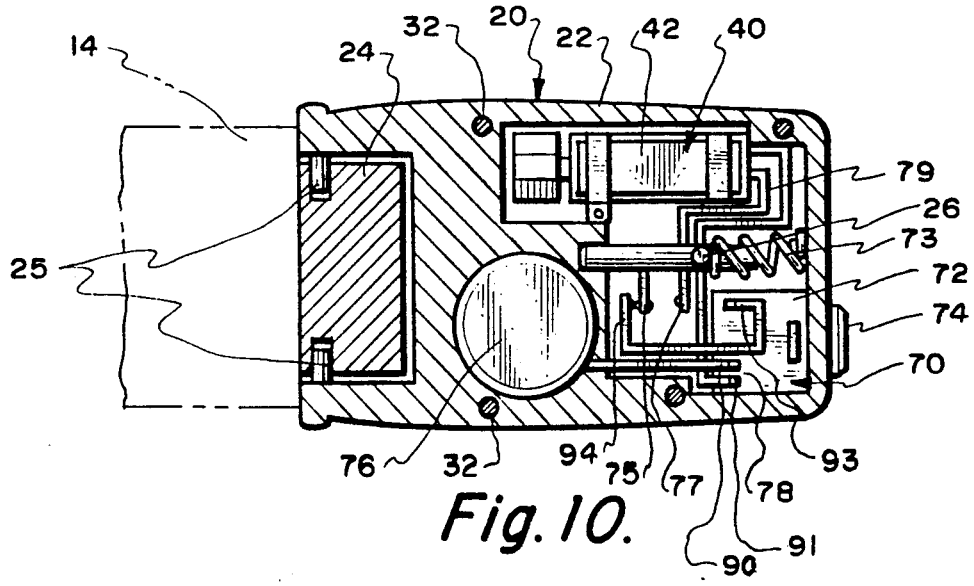
FIG. 10 is a sectional view similar to FIG. 6, but illustrating yet another alternative embodiment of the switching means of the invention with its switch means open.
Figure 12:
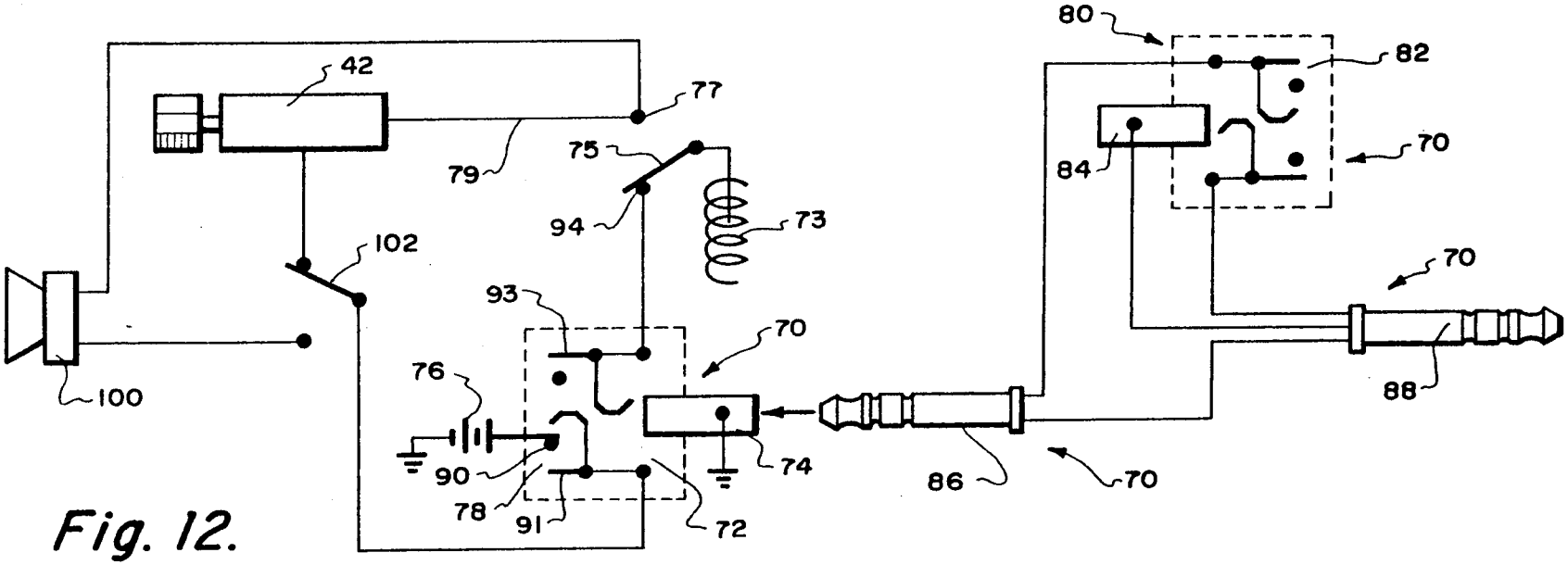
FIG. 12 is a schematic representation of an electrical circuit of an embodiment of the invention whereby a buzzer means, a vibrating motor member, or interruption of a portable stereo or radio may be utilized as the indicator means.

Another embodiment of my invention, FIGS. 10-11, includes speaker interruption means, shown as a stereo headphone jack assembly 70, as a component of the signalling or indicator means 40. The jack assembly 70 includes a miniature stereo jack 72 with a female jack receptacle 74 operably mounted in the buckle means 20. The jack assembly further includes adaptor means 80, as illustrated in FIG. 12, external to the buckle means 20. Adaptor means 80 interconnects the buckle member 22 with a radio or stereo such as a Walkman, not shown, and the headphones or speakers associated therewith, also not shown.

Adaptor means 80 further includes a miniature stereo jack 82 similar to jack 72, with a female jack receptacle 84 similar to receptacle 74. The female jack receptacle 84 is configured to operably receive a male jack member (not shown) of the headphones or speakers (not shown) of the radio, thereby connecting the adaptor means 80 to the headphones.

Adaptor means 80 further includes a male jack member 86 for operably connecting adaptor means 80 to the female receptacle 74 of the belt buckle 22. Similarly, adaptor means 80 also includes a male jack member 88 for operably connecting adaptor means 80 to the female receptacle (not shown) of the radio (not shown).

The embodiment of FIGS. 10-11 may be operated without the male jack member 86 inserted into the female receptacle 74; that is, without the adaptor means 80 or the radio connected to the belt buckle 22. In such a mode of operation, the vibration motor 42 serves as the indicating means 40. A battery 76 is electrically connected to the miniature stereo jack 72 and, through a normally closed switch 78 in jack 72 comprising contact members 90 and 91 normally in conductive contact with one another, FIG. 12, to the vibration motor 42. A ground wire 79 of the circuit connects the motor 42 to a first contact member 77, FIG. 10. A second contact member 75 operatively protrudes from and is conductively connected to the actuating arm 26, which arm is grounded to the belt buckle 22 through a spring 73 or similar expedient. When sufficient tension force is applied to the actuating arm 26, the biasing force of the spring 73 is overcome and the first and second contact members 77 and 75 are brought into electrically conductive contact, FIG. 11, completing the circuit to the vibration motor 42 and activating same.

When the wearer desires to utilize a radio as the signalling means 40, however, he inserts the male jack member 86 into the female receptacle 74. This opens the switch 78 in the miniature stereo jack 72 by moving the members 90 and 91 out of contact with one another, and thus disenables the vibration motor 42. As indicated below, the device of my invention could alternatively be constructed so that inserting the male jack member would not disable the vibration motor 42, thereby permitting a multitude of signalling means to indicate the unacceptable tension in the belt member 14.

Inserting the male jack member 86 into the miniature stereo jack 72 also provides a ground for one of the speakers or one of the headphones of the Walkman-type radio. The grounding circuit includes a contact 93 in the miniature jack 72, FIG. 10, a contact member 94 biased into conductive contact with grounded contact member 75 described above, and the wiring between the contact members 93 and 94. When the biasing force of the spring member 73 is overcome because of the wearer's undesirable relaxing or slouching, the actuating arm 26 slides as described above and the member 75 is moved out of contact with member 94, thereby breaking the speaker circuit and interrupting the broadcast of music or other sounds through the speaker.

Those skilled in the art will understand that inserting the headphone male jack member (not shown) into the female receptacle 84 and inserting the male jack member 88 of the adaptor means 80 into the Walkman-type radio (not shown) will provide the remaining circuit necessary to allow the radio to serve as the signalling means 40 of the invention. In short, interposing the adaptor means 80 and the associated belt buckle means 20 between the radio and its speakers or headphones, as indicated in FIG. 12, permits the sliding action of the actuating arm 26 to interrupt the broadcast of the radio to one of the speakers of the headphone set.

The Walkman-type radio is preferably mounted on the belt member 14 through the use of known clip means. For further convenience to the wearer, the connecting wiring of the adaptor means 80 may be formed in an elastic coiled configuration similar to that connecting a telephone headset to its base. This configuration permits ready assembly of this embodiment, and retracts the wiring into a convenient shape for storage when not in use.

It has been found that, for wearers who exercise while listening to Walkman-type stereos, the embodiment of FIGS. 10-11 is extremely useful, for several reasons. During vigorous exercise, the relatively gentle signalling vibration created by the vibration motor 42 may not be noticeable to the wearer, and therefore may not serve well as a signalling means. The stereo to which the wearer is listening, in contrast, is usually broadcasting at a sufficiently high volume so that the wearer will notice in interruption in the broadcast to one of the speakers; thus, such an interruption is effective to signal the wearer to tighten his abdominal muscles or straighten his posture during the exercise. As indicated elsewhere, the invention could be practiced with both the stereo interruption and the vibration motor 42 as signalling means, but at least during vigorous exercise, the operation of the vibration motor appears to be an unnecessary drain on the energy of the battery means 76. Additionally, although the stereo interruption means of the invention could easily be fabricated so that both speakers of the headphones were interrupted, it has been found that interruption of one speaker provides a sufficient signal to the wearer while permitting him or her to continue to enjoy and exercise to the broadcast.

Another alternative embodiment of the invention, FIG. 12, signalling means 40 includes a sound-producing member such as buzzer means 100 and selecting switch means 102 to allow the wearer to select a signalling means of either the buzzer 100 or the vibration motor 42 type. In this embodiment, the switch 102 is preferably operable from the exterior of the belt buckle member 22 and the buzzer means 100 produces an audible signal to indicate when the undesirable slouching or relaxing occurs. Those skilled in the art will understand that the switch 102 could be omitted, whereby the vibration motor 42 and the buzzer means 100 could be simultaneously activated by the undesirable slouching or relaxing.

Although the embodiments of my invention illustrated in FIGS. 10–12 include combinations of a vibration motor 42, speaker interruption means 70, and buzzer means 100, those skilled in the art will understand that any of these signalling means 40 or numerous others, alone or in combination, may serve as the indicator means of the invention without departing from the scope thereof. Furthermore, selecting switch means 102 could be provided to allow the wearer to select desirable combinations of these components to be activated as the indicator means 40.

Figure 13:
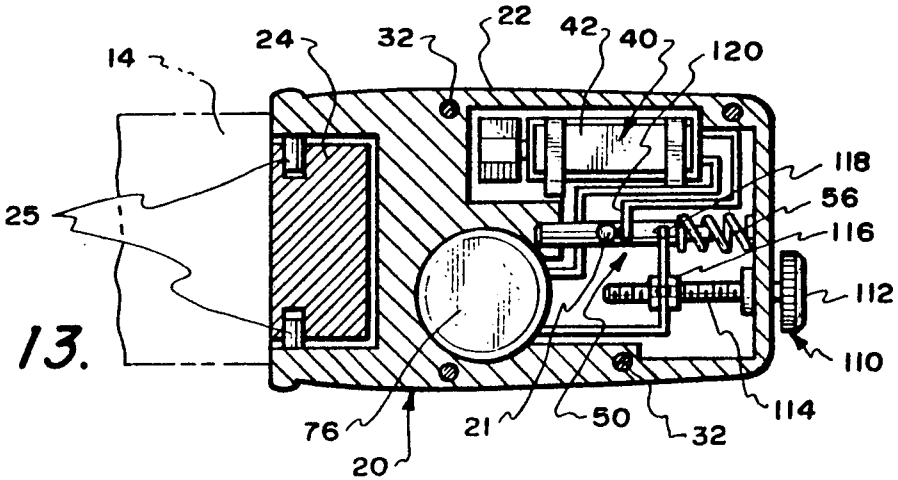
FIG. 13 is a sectional view similar to FIG. 6, but illustrating a preferred embodiment of the adjustment means of the invention.

To permit the wearer to adjust the amount of tension in the belt means 12 required to complete the circuit and activate the signalling means 40, adjustment means 110, FIG. 13, may be provided. In the preferred embodiment, a control knob 112 is rotatably mounted on the exterior of the buckle member 22. The control knob 112 is connected to a threaded shaft member 114 that extends into an internal cavity in the buckle 22, where a contact positioning nut 116 is threadedly mounted thereon. Rotation of the control knob 112 causes the positioning nut 116 to migrate along the length of the shaft 114. A switch contact 118 is operably connected to the positioning nut 116 so that it correspondingly migrates with the nut 116. A vibration motor contact 120 is operably attached to the actuating arm 26 so that sufficient displacement of the actuating arm will bring contact 120 into an electrically conductive relationship with the switch contact 118, activating the vibration motor 42.

By using this adjustment means 110, the wearer may vary and control the amount of tension in belt member 22 required to compress the spring 56 and complete the circuit for indicator means 40. Thus, a desired sensitivity of the activation or switch means 50 may be achieved with any of a wide range of belt means 12, by virtue of the combination of the adjustment means 110 with the range of holes 28 along the second end of the belt member 14 or the selectability of the functional length of belt means 12 that may be tied to the U-shaped member 60.

The posture monitoring device of my invention has been described with some particularity but the specific designs and constructions disclosed are not to be taken as delimiting of the invention in that various obvious modifications will at once make themselves apparent to those of ordinary skill in the art, all of which will not depart from the essence of the invention and all such changes and modifications are intended to be encompassed within the appended claims.

I claim:

1. In a signalling device to be worn around or near a person's waist or abdominal region to indicate expansion of said region, the combination of: belt means having first and second ends and extending around said abdominal region of the wearer; housing means attached to said first end of said belt means; vibration-producing means operably associated with said housing means; indicator means operably associated with said housing means and with said vibration-producing means; and switch means operably associated with said indicator means and said second end of said belt means, whereby when said abdominal region is expanded beyond a selected dimension, said switch means activates said indicator means, alerting said person that said expansion has occurred; in which said indicator means is constituted by means for interrupting the vibration of said vibration-producing means.

2. In a signalling device to be worn around or near a person's waist or abdominal region to indicate expansion of said region, the combination of: belt means having first and second ends and extending around said abdominal region of the wearer; housing means attached to said first end of said belt means; vibration-producing means operably associated with said housing means; indicator means operably associated with said housing means and with said vibration-producing means; and switch means operably associated with said indicator means and said second end of said belt means, whereby when said abdominal region is expanded beyond a selected dimension, said switch means activates said indicator means, alerting said person that said expansion has occurred; in which said indicator means is constituted by means for interrupting the vibration of said vibration-producing means; and in which said vibration-producing means includes a vibrating motor contained in said housing means.

3. In a signalling device to be worn around or near a person's waist or abdominal region to indicate expansion of said region, the combination of: belt means having first and second ends and extending around said abdominal region of the wearer; housing means attached to said first end of said belt means; means for broadcasting music or other desirable ongoing audio stimuli, such means being operably associated with said housing means; indicator means operably associated with said housing means and with said means for broadcasting music or other desirable ongoing audio stimuli; and switch means operably associated with said indicator means and said second end of said belt means, whereby when said abdominal region is expanded beyond a selected dimension, said switch means activates said indicator means, alerting said person that said expansion has occurred; in which said indicator means is constituted by means for interrupting said broadcast of music or other desirable ongoing audio stimuli.

4. The signalling device of claim 1 or claim 2 or claim 3 in which said housing means constitutes a buckle for said belt means.

5. The signalling device of claim 4 in which said housing means includes a contacting surface that approaches coplanarity with respect to the curvilinear plane of the surface of said abdominal region.

6. The device of claim 4 in which said switch means includes a spring-activated arm member.

7. The device of claim 4 further including adjustment means to adjust the amount of said expansion required to close said switch means.

8. The device of claim 3 in which said means for broadcasting music or other desirable ongoing audio stimuli is constituted by a stereo or radio.

9. In a posture improvement device, the combination of: a belt member having a first end and a second end; buckle means operably connecting said first and second ends; switch means operably associated with said buckle means and configured to operate in response to a predetermined tension level in said belt member; vibration-producing means operably associated with said buckle means; and indicator means operably associated with said switch means and with said vibration-producing means to indicate to the wearer of said device that said tension level has been reached; in which said indicator means is constituted by means for interrupting the vibration of said vibration-producing means.

10. The device of claim 9 in which said buckle means constitutes a belt buckle attached to a first end of said belt member; said switch means includes an activating arm member engaged with said belt buckle and operably attached to a second end of said belt member; and said switch means further includes spring biasing means to bias said arm member so that said switch is in a normally open setting, whereby when said tension level occurs, said bias of said spring means is overcome and said arm member slides with respect to said belt buckle and closes said switch.

11. The device of claim 10 further including adjustment means to adjust the amount of tension required to overcome said spring biasing.

12. The device of claim 9, claim 10 or claim 11 vibration-producing member includes a vibrating motor contained in said housing means.

13. The device of claim 9 or claim 10 or claim 11 further including means for producing music or other desirable ongoing audio stimuli, and further including second indicator means for interrupting said production of music or other desirable ongoing audio stimuli being received by the wearer of the device.

14. The device of claim 13 in which said means for producing music or other desirable ongoing audio stimuli is constituted by a stereo or radio.

15. In a posture indicating mechanism, the combination of: a belt member having first and second ends; a buckle member attached to said first end of said belt member; activation means including a spring-biased actuating arm member operably engaged with said buckle member and said second end of said belt member; signal-producing means associated with said buckle member, said signal-producing means including a vibration motor and audio signal-producing means; means for interrupting the operation of said vibration motor and said audio signal-producing means; selecting means incorporated in said buckle member for selecting one or more of said signal-producing means; and adjustment means incorporated in said buckle member for adjusting the spring bias of said arm member; whereby when said belt member is tensioned to overcome said bias, said interruption means interrupts said signal-producing means to indicate that said tension level has been reached.

16. In a posture improvement device, the combination of: a belt member having a first end and a second end; buckle means operably connecting said first and second ends; switch means operably associated with said buckle means and configured to operate in response to a predetermined tension level in said belt member; and indicator means operably associated with said switch means to indicate to the wearer of said device that said tension level has been reached; in which said indicator means is constituted by means for the interruption of broadcasting music or other desirably ongoing audio stimuli.

17. The device of claim 16, in which said buckle means constitutes a belt buckle attached to a first end of said belt member; said switch means includes a moveable activating arm member slidably engaged with said belt buckle and operably attached to a second end of said belt member; and said switch means further includes spring biasing means to bias said arm member so that said switch is in a normally open setting, whereby when said tension level occurs, said bias of said spring means is overcome and said arm member slides with respect to said belt buckle and closes said switch.

18. The device of claim 17 further including adjustment means to adjust the amount of tension required to overcome said spring biasing.

19. The device of claim 16 or claim 17 or claim 18 in which said indicator means includes a vibration-producing member.

* * * * *